US006907680B2

(12) United States Patent
Mariotti

(10) Patent No.: US 6,907,680 B2
(45) Date of Patent: Jun. 21, 2005

(54) METHOD FOR DRYING LAUNDRY AND MACHINE IMPLEMENTING SUCH A METHOD

(75) Inventor: Constantino Mariotti, Sigillo (IT)

(73) Assignee: Merloni Elettrodomestici S.p.A., Fabriano (IT)

( * ) Notice: Subject to any disclaimer, the term of this patent is extended or adjusted under 35 U.S.C. 154(b) by 98 days.

(21) Appl. No.: 10/258,494

(22) PCT Filed: Apr. 24, 2001

(86) PCT No.: PCT/IB01/00603

§ 371 (c)(1),
(2), (4) Date: Dec. 9, 2002

(87) PCT Pub. No.: WO01/83871

PCT Pub. Date: Nov. 8, 2001

(65) Prior Publication Data

US 2004/0099655 A1 May 27, 2004

(30) Foreign Application Priority Data

Apr. 28, 2000 (IT) ..... TO2000A0406

(51) Int. Cl.[7] ..... F26B 3/00
(52) U.S. Cl. ..... 34/486; 34/562
(58) Field of Search ..... 34/486, 491, 549, 34/553, 562, 596, 603, 606; 68/12.01

(56) References Cited

U.S. PATENT DOCUMENTS 3,419,708 A * 12/1968 Niewyk et al. ..... 219/501
3,647,196 A * 3/1972 Cotton ..... 432/37
4,397,101 A * 8/1983 Rickard ..... 34/486
4,418,271 A * 11/1983 Smock ..... 219/493
5,673,497 A * 10/1997 St. Louis ..... 34/486
5,696,695 A * 12/1997 Ehlers et al. ..... 700/286
5,782,012 A * 7/1998 Sanders et al. ..... 34/527
6,079,121 A * 6/2000 Khadkikar et al. ..... 34/528

FOREIGN PATENT DOCUMENTS

GB 2 122 381 * 1/1984 ..... D06F/58/28

* cited by examiner

*Primary Examiner*—Stephen Gravini
(74) *Attorney, Agent, or Firm*—Levine & Mandelbaum

(57) ABSTRACT

Method for drying laundry and a machine able to implement such a method, which provides for the use of only one electric resistance for heating the air utilized for drying purposes.

According to the invention, during the starting phase of the drying process, i.e. the initial stage of the air heating, said resistance is applied continuously for exploiting its maximum power and quickly reach a predetermined temperature of the drying air.

Following the attainment of said predetermined temperature, a special control circuit causes said resistance to be applied in a shuttered or modulated way, i.e. by alternating application phases to non-application phases within repetitive reference periods, in order to manage the power of the resistance in its steady-state condition for obtaining a substantial constancy of the air temperature.

34 Claims, 1 Drawing Sheet

METHOD FOR DRYING LAUNDRY AND MACHINE IMPLEMENTING SUCH A METHOD

BACKGROUND OF THE INVENTION

The present invention relates to a method for drying laundry and a machine able to dry laundry implementing such a method.

As known, some types of household appliances have the capability of drying the laundry after washing; typically, these appliances are the so-called wash-and-drying machines performing both the washing and the subsequent drying of the laundry, and laundry drying machines, which are only provided for drying the laundry.

These machines have a drum for containing the laundry to be dried, which is made to rotate for a preset time at a determined speed, while warm air is introduced into the tub wherein the drum is rotating; the drum rotation speed during drying is relatively low, typically about 55 revolutions per minute (r.p.m.); the drying time is generally set manually by means of a dedicated timing device, according to the user's specific needs (i.e., substantially as a function of the degree of drying to be reached and the type of clothes to be dried).

In order to dry the laundry, a certain "steady-state" temperature should be maintained within the tub wherein the drum is rotating, usually about 130° C.; to this purpose, the machine is provided with a suitable air circulation and heating system, comprising a blower, one or more electric resistances and condensing means for the damp air sucked from the tub.

Quite schematically, the damp air in the tub is sucked through the blower intake branch, along which the condensing means are also located; one or more electric resistances provided along the blower delivery side heat the dehumidified air before reintroducing it into the tub.

More conventional systems have only one air heating resistance, whose power is substantially sized for maintaining the steady-state temperature, of about 130° C. as an average.

Such an embodiment is shown schematically by way of example in FIG. 1.

In this figure, reference L and N indicate the phase and neutral wire of the 220 VAC mains supply and reference R indicate the above heating element or resistance, rated 1.000 W by way of example.

The heating element R is driven by a suitable electric switch C; in the instance of machines fitted with an electromechanical control system, this switch is a contact of a timer, whereas for machines fitted with an electronic control system, it may consist of the movable contact of a suitable relay.

Reference T indicates a thermostat of a known type, connected in series to the supply of the heating element R, which prevents reaching potential damaging temperatures within the machine tub; let assume that the upper threshold of intervention of the thermostat T is 140° C.

Upon starting the drying program, the switch C is made to closed and is maintained in this condition for the whole program, so as to enable the supply of the heating element R; in the event the threshold temperature is exceeded, the thermostat T cuts off the supply to the heating element R and activates it again, if required, should the actual temperature detected by the thermostat T decrease below the lower threshold of intervention of the latter.

The system illustrated in FIG. 1 represents a simple and cost-effective system, but is featured by a poor performance.

A first drawback related to the solution shown in FIG. 1 is represented by the fact that the control of the supply of the heating element R is assigned to an electromechanical thermostat, which typically has a high differential or hysteresis.

This problem can be cleared considering, for example, that the higher is the laundry load to be dried within the machine drum, the higher will be the volume increase of the laundry within the drum during the drying process, above all after the initial phase (i.e. with the clothes being still soaked with water and piled together); therefore, the space in the tub for the warm air decreases, so causing a temperature increase. As a result, at a certain time of the drying program, the air temperature within the tub will inevitably exceed the threshold of intervention of the thermostat T; as mentioned above, thermostats commonly employed to this purpose are featured by a high differential.

Upon exceeding the threshold temperature, here assumed to be 140° C. as mentioned, the thermostat T interrupts the supply to the heating element R, through the opening of one of its contacts, and the temperature in the tub will gradually decrease. Before the electric contact of the thermostat T closes again for a new supply to the heating element R to continue the drying program, the air temperature within the tub decreases to about 110° C., due to the cited differential.

Even if the decrease of the temperature in the tub is relatively fast, it is clear how the system described with reference to FIG. 1 is not very efficient, due to its waste of time and thermal energy, above all considering that during a drying program, particularly in the instance of a high laundry load, the electric contact of the thermostat T will forcedly be subject to a plurality of opening/closing cycles.

Another drawback related to the solution of FIG. 1 is represented by the fact that the heating element R is specifically sized for maintaining the rated drying temperature, i.e. the cited 130° C.

However, due to this sizing, the initial phase of the drying, during which the rise to the rated temperature is realized, requires a relatively long time, i.e. representing a further poor element of the system.

Washing machines and/or drying machines fitted with two electric resistances or heating elements for the air heating have been suggested, in order to reduce the above drawbacks, as highlighted in FIG. 2.

Both heating elements, indicated with R1 and R2, are driven by relevant electric switches C1 and C2, of the previously mentioned type, and provide respective thermostats T1 and T2 connected in series to the supply, which are calibrated for operating at different temperatures. In the illustrated example, the heating element R1 has a 1.000 W power, suitable for maintaining the rated drying temperature, whereas the heating element R2 has a 500 W power; the thermostat T1 is calibrated for threshold of intervention of about 140° C. whereas the thermostat T2 is calibrated for a threshold of intervention of about 125° C.

Upon starting a drying program, switches C1 and C2 are made to close and maintained in that condition for the whole program, so enabling the supply to the heating elements R1 and R2.

Thus, the sum of the individual heating powers of the two heating elements R1 and R2 allows a fast achievement of the rated drying temperature.

As said, the thermostat T2 is calibrated for a lower threshold of intervention compared to the threshold of thermostat T1 provided for controlling the rated temperature; it should also be noticed that the differential of the two thermostats T1 and T2 remains substantially always the same.

This means that, upon reaching 125° C., the electric contact of the thermostat T2 will open and inhibit the power supply to the heating element R2, whereas the heating element R1 is still supplied for air heating as required to maintain the rated temperature.

Should the temperature inside the tub exceed the 140° C. safety threshold, the thermostat T1 would stop supplying the heating element R1 through the opening of its own contact, so that the temperature in the tub will gradually decrease.

Also in this case, before the electric contact of the thermostat T1 can close again for a new power supply to the heating element R1, as required to carry on the drying program, due to the above thermostats differential the air temperature inside the tub has to drop down to about 110° C.

It should be noticed, here, that in this circumstance the contact of the thermostat T2 remains in the open condition, since its lower switching temperature (95° C.) will always be lower compared to the lower switching temperature of the thermostat T1 (110° C.).

Therefore, as it can be noticed, performance of the drying program can be partially improved by the solution illustrated in FIG. 2, i.e. reducing the rise time to the rated temperature.

However, this is an expensive solution, in as much as it presumes the use of two heating elements, two control contacts and two thermostats.

As an alternative to the solution described above, it should be noticed that the inhibition of the supply to the heating element R2 might be obtained directly through the contact C2 instead of a thermostat; to this purpose, the machine control system (either electromechanical or electronic) will control the opening of the contact C2 after a fixed time since starting the drying program (e.g. 10 minutes), so that during the further program development air heating is ensured by the heating element R1 alone.

However, also this solution is not a very practical one, since it requires the use of two heating elements, two supply contacts and one thermostat.

Apart from the type of control employed for the heating element R2, the above solution would not prevent the problem previously mentioned of the cyclicity of intervention of the thermostat T1, should the safety temperature be exceeded.

SUMMARY OF THE INVENTION

The present invention has the aim of solving the drawbacks previously mentioned with reference to the prior art and providing, in particular, a method for drying laundry and a relevant machine being more efficient, more reliable and cheaper than the known solutions.

Within this frame, it is a first aim of the invention to provide a method for drying laundry and a relevant machine, wherein the "steady-state" temperature can be reached within relatively short times, but in a simple low and cost way, in particular employing only one resistance.

A second aim of the invention is to provide such a method and a relevant machine wherein the "steady-state" temperature can be maintained substantially constant, so avoiding a marked saw-teeth advancement determined by the differential or hysteresis of the thermostats according to the prior art.

A third aim of the present invention is to provide such a method and a relevant machine, warranting the compliance to the Standards on electromagnetic compatibility, wherein risks of fault and malfunction of the switching elements in the power supply circuit to the air heating element are minimized.

A fourth aim of the present invention is to provide such a method and a relevant machine employing simple and low-cost components.

One or more of said aims are attained, according to the present invention, by method for drying laundry and a machine able to dry laundry, incorporating the features of the annexed claims, which form an integral part of the present description.

DESCRIPTION OF THE DRAWINGS

Further aims, features and advantages of the present invention will become apparent from the following detailed description and the annexed drawings, which are supplied by way of non limiting example, wherein.

DESCRIPTION OF THE PREFERRED EMBODIMENT

The basic idea of the present invention is to employ only one air heating resistance, which has a decidedly oversized heating power with respect to the power required for maintaining the normal "steady-state" temperature of drying, so as to reach said temperature very fast and then modulate its heating power in an appropriate way.

To this purpose, during the initial phase of the drying process, i.e. initial stage of the air heating, the resistance or heating element is supplied with continuously, so as to exploit its maximum heating power and quickly reach a predetermined temperature for the drying air.

Following the attainment of said predetermined temperature, the power of the heating element is modulated, by alternating supply periods to periods of interruption of its supply, i.e. non-supply periods, in order to manage said power in the steady-state phase for obtaining a substantial constancy of the temperature.

Figure 1:
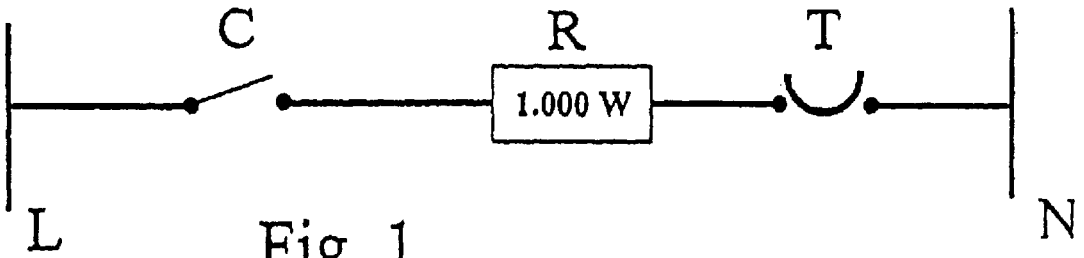
FIG. 1 shows schematically the electric supply circuit of an heating resistance of the drying air of a laundry dryer according to a first known solution.
Figure 2:
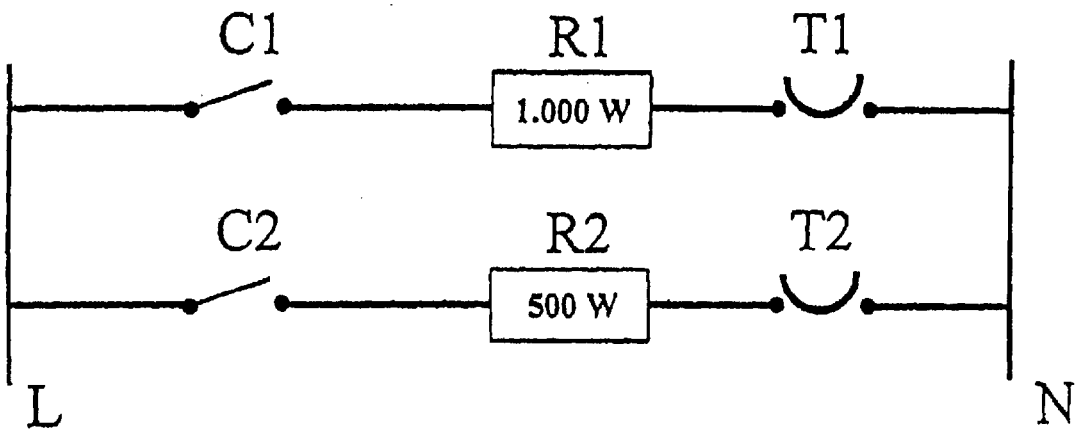
FIG. 2 shows schematically the electric supply circuit of a pair of heating resistance of the drying air of a laundry dryer according to a second known solution.
Figure 3:
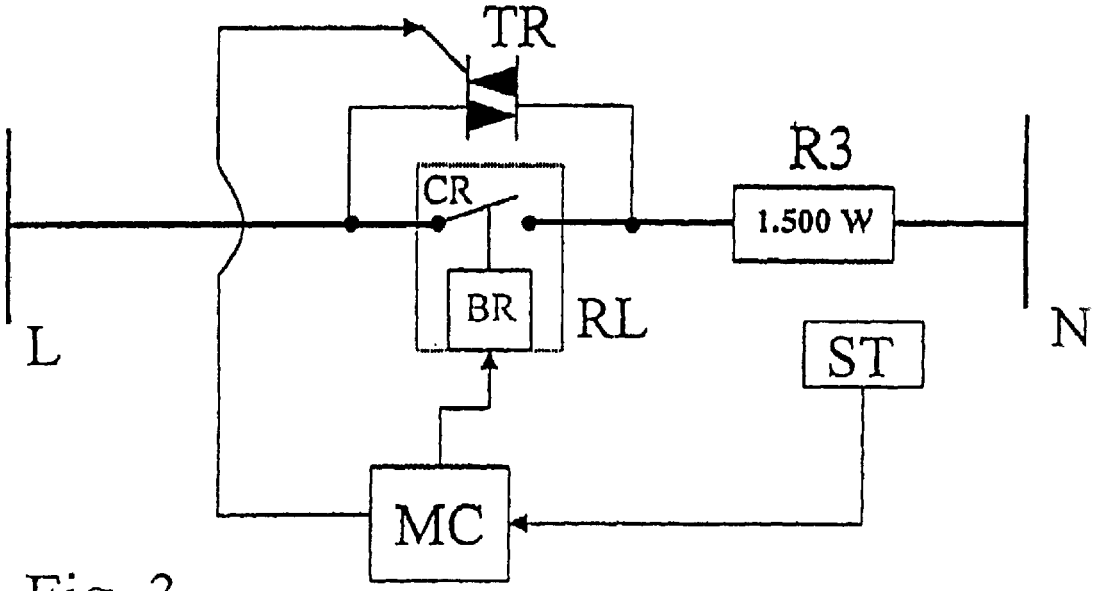
FIG. 3 shows schematically the power supply circuit of an heating resistance of the drying air of a machine able to dry laundry according to the present solution.

FIG. 3 represents schematically a possible embodiment of the supply and control circuit of an air heating resistance of the drying air for a machine able to dry the laundry according to the present invention, through which the above aims can be achieved, avoiding the drawbacks previously mentioned.

To this purpose, let us assume that the machine according to the invention is equipped with an air circulation system of a known type, as described at the beginning of the present description.

In FIG. 3, references L and N indicate the phase and neutral of a 220 VAC supply line, respectively.

Reference R3 indicates a heating resistance for the drying air, hereinafter referred to as heating element; according to the present invention, the heating element R3 has decidedly an oversized power compared to the one required for maintaining the normal steady-state temperature for the drying process.

In general it should also be noticed, that the value of the air temperature for obtaining an efficient drying effect differs according to the type of laundry being handled; therefore, in the preferred embodiment of the invention, the drying machine can be advantageously provided with suitable selection means, for allowing the user to set a desired drying temperature, which is variable in function of the type of laundry to be dried.

For simplicity's sake, let us suppose that the maximum selectable temperature is 130° C. and, as said above, the heating element R3 is oversized with respect to such a limit value: by way of example, the heating element R3 can be assumed to have a power of 1.500 W.

Moreover, the machine according to the invention is preferably provided with means for setting the drying time, the latter being generally variable according to the user's needs (i.e. substantially in function of the drying degree to be obtained and the type of clothes to be dried).

Reference MC indicates a electronic microcontroller of a known type, for example of the type being usually employed in the electronic control system of a laundry washing and/or drying machine.

Reference RL indicates a relay having a coil BR and a normally open movable contact CR connected in series on the supply line of the heating element R3; the coil BR is destined to be energized in a known way, under the control of an appropriate output of the microcontroller MC for producing the switching of the contact CR.

Reference TR indicates a solid state electronic switch, which in the given example is a triac connected on the supply line to the heating element R3 in parallel to the relay RL; an appropriate output of the microcontroller MC is connected to the "gate" of the triac TR, for controlling the operation of the latter.

Finally, reference ST indicates a temperature sensor being associated in use to the body of a blower being part of the heating and circulation system of the drying air, not shown in the figures for simplicity's sake; the sensor ST, which may be for example a resistor with a negative temperature coefficient or NTC, is connected to an appropriate input of the microcontroller MC.

Therefore, through the sensor ST the microcontroller MC is able to compare the actual temperature of the drying air with the predetermined temperature value, 130° C. as said, and provide, if required, an output for the control of the triac TR and the relay RL, as described in the following.

According to the invention, the microcontroller MC is appropriately programmed to realize a temperature control of the proportional type, i.e. directed to change the mean power dispensed by the heating element R3, so as to avoid the exceeding of a given threshold of intervention, but rather the predetermined value of 130° C. can be approached maintaining a substantial constancy of the temperature.

According to the invention, this modulation is realized by the microcontroller MC through switching operations (ON and OFF) of the supply to the heating element R3, by means of the relay RL and the triac TR, during repetitive reference periods; according to the invention, these reference periods preferably last 40 sec, in order to avoid sudden voltage drops of the household electric mains supplying the drying machine according to the invention.

The above said proportional control being directed to change the ratio of the ON time (i.e. supply to the heating element R3) with respect to OFF time (i.e. non-supply to the heating element R3) within one same reference period is based on a preset proportional range, laying in the surroundings of the value of predetermined temperature of 130° C.

By way of a specific schematic example, reference can be made to the following Table 1, wherein the predetermined temperature value is equals to the above 130° C., the above proportional range has an amplitude of 8° C. (i.e. ±4° C. with respect to the predetermined temperature value) and the repetitive reference periods are of 40 seconds.

TABLE 1

| | ON Percentage | ON Time (sec.) | OFF Time (sec.) | Detected temperature |
|---|---|---|---|---|
| 1 | 0.00% | 0 | 40 | Over 134° C. |
| 2 | 0.00% | 0 | 40 | 134° C. |
| 3 | 12.50% | 5 | 35 | 133° C. |
| 4 | 25.00% | 10 | 30 | 132° C. |
| 5 | 37.50% | 15 | 25 | 131° C. |
| 6 | 50.00% | 20 | 20 | 130° C. |
| 7 | 62.50% | 25 | 15 | 129° C. |
| 8 | 75.00% | 30 | 10 | 128° C. |
| 9 | 87.50% | 35 | 5 | 127° C. |
| 10 | 100.00% | 40 | 0 | 126° C. |
| 11 | 100.00% | 40 | 0 | Below 126° C. |

As it can be noticed, when the temperature detected by the sensor ST exceeds the lower and upper limits of the proportional range, the system operates like a normal ON/OFF control: therefore, when the detected temperature is equal to or lower than 126° C., the supply to the heating element R3 is enabled for all the 40 seconds of the reference period; vice-versa, when the detected temperature is equal to or above 134° C., the supply to the heating element R3 is disabled for the whole reference period. On the contrary, when the temperature detected by the sensor ST falls within the proportional range, the supply to the heating element R3 is shuttered or modulated, i.e. the supply and non-supply times within the 40 sec period are varied in function of the difference existing between the temperature actually detected and the predetermined temperature.

As it can be noticed for example at the position 6 of Table 1, when the temperature detected by the sensor ST corresponds to the predetermined temperature (130° C.), the ON:OFF ratio is equal to 1:1, i.e. the supply time of the heating element (20 sec.) is substantially equal to the non-supply time of the heating element (20 sec.); vice-versa, if according to position 3 of Table 1, the detected temperature (133° C.) exceeds the predetermined value (130° C.), the supply time of the heating element (5 sec.) will generally be lower than non-supply time (35 sec.); vice-versa, if according to the position 8 of the Table 1, the detected temperature (128° C.) is below the predetermined value (130° C.), the supply time of the heating element (30 sec.) will generally exceeds the non-supply time (10 sec.).

Therefore, as it can be noticed, within the proportional range delimited by the two threshold values of 126° C. and 134° C., the ON/OFF switching within the reference period of 40 seconds is performed in function of the difference existing between the detected temperature value and the predetermined value.

It should be noticed, in general, that when the temperature detected by the sensor ST during a certain reference period is lower than the predetermined temperature, the control system will increase, during the subsequent reference period, the supply time of the heating element R3 with respect to the supply time utilized during the previous reference period. Vice-versa, when the temperature detected by the sensor ST during a certain reference period is higher than the predetermined temperature, the control system will reduce, during the subsequent reference period, the supply time of the heating element R3 with respect to the supply time utilized during the previous reference period.

An example of operation of the supply and control circuit of the air heating element according to the present invention is now described with reference to the schematic representation of FIG. 3 and Table 1; since the operating principles of the relay RL and triac TR are well known to the man skilled in the art, they will not be further detailed in the following description.

The user sets, through the selecting or setting means previously mentioned, the drying time and temperature; let us assume that the selected time is 60 minutes and the selected temperature is 130° C.

The circuit is in the condition of FIG. 3, with the contact CR of the relay RL being open and the triac TR being non conductive.

After the user has started the drying program, e.g. by pressing a key, the microcontroller MC sends a first control pulse to the gate of the triac TR, until the latter becomes conductive and so closing the circuit from the supply source to the electric load represented by the heating element R3; due to the opening condition of the contact CR of the relay RL, the whole current flows through the triac TR.

After sending a first pulse to the triac TR being long enough to bring it in conduction (e.g. after 20 milliseconds, i.e. the duration of a 220 VAC-50 Hz mains voltage cycle), the microcontroller MC provides for controlling the supply to the coil BR of the relay RL, so as to close the contact CR of the latter.

After a predetermined time, deemed to be sufficient for realizing the switching of the contact CR, the microcontroller MC sends a second control pulse to the triac TR, so that the latter ceases to be conductive; therefore, in this condition, all the current now flows through the contact CR of the relay RL.

It should be noticed that the average time required for switching a relay is 10–20 milliseconds; however, for safety reasons, the above predetermined time elapsing between the start of the supply to the coil BR and the sending of the second control pulse to the triac TR, may also be longer, such as equalling four mains voltage cycles (i.e. 80 milliseconds).

Therefore, it should be noticed that the triac TR stops being conductive after a predetermined time (the cited 80 milliseconds); this protects the triac, in the sense that the latter will not continue to bear the high current load also when the contact CR of the relay RL does not close correctly.

From the above it is also clear that the triac TR remains in conduction, and therefore bears all the current required for supplying the heating element R3, for a few tens of milliseconds only; as a result, no overheating of the triac TR itself occur, which may therefore have a moderate rating and not require any heat dissipating means.

It should also be noticed that, according to the invention, the microcontroller MC is programmed for realizing the switching operations of the triac TR in correspondence of the zero-crossing, i.e. the point of the waveform of the alternate current where voltage is zero; therefore, when the voltage of the circuit is zero, no current flow takes place, with a consequent simpler and safer switching of the triac TR and with the further advantage of avoiding electromagnetic or radio-frequency noises.

The heating element R3 is then supplied with continuosly through the contact CR, for fully exploiting its heating power; in this phase we are therefore substantially in the condition 11 of Table 1; this means that during the above repetitive reference periods of 40 seconds, the heating element R3 is constantly supplied.

As previously cleared, according to the invention, at the beginning of a drying program it is necessary to obtain a rapid attainment of the steady-state temperature, as said, this is obtained by using a heating element R3 having an oversized heating power with respect to the power required for maintaining the steady-state temperature of drying, that is the selected one of 130° C.

The microcontroller MC is appropriately programmed so that, after the start of the drying cycle, the heating element R3 supplied with continuously as described above, until the same microcontroller detects through the sensor ST that the predetermined temperature of 130° C. has been reached.

Once this value of predetermined temperature has been detected, the duly programmed microcontroller MC starts the control of proportional type of the supply of the heating element R3, in accordance with the procedures previously described with reference to Table 1. This means that the microcontroller MC will control the triac TR and the relay RL for realizing, within one or more of the reference periods of 40 seconds, the pulse supply of the heating element R3.

In the specific case, the 130° C. value has been reached in constancy of supply of the heating element R3 using the relay RL; after this temperature has been detected, reached following the start of the cycle, the microcontroller MC will have to disable the supply of the heating element for 20 of the 40 seconds of the reference period (position 6 of Table 1).

This implies the contact CR to switch from its closed condition to the open condition, which is realized as follows:

the microcontroller MC provides for sending a first control pulse to the gate of the triac TR until the latter is made conductive; the current in the circuit is therefore split between the triac TR itself and the contact CR of the relay;

after the first pulse to the triac TR has been sent (e.g. 20 milliseconds later), the microcontroller MC provides for controlling the supply to the coil BR of the relay RL, so as to cause the opening of its contact CR; the start of the motion of the contact CR (which occurs a few milliseconds after supplying the coil BR), makes a resistance to arise in the circuit, that causes the current to follow the preferential path to the triac TR; all the current now flow through the triac TR;

after a predetermined time, deemed to be sufficient for realizing the switching of the contact CR (e.g. the already cited 80 milliseconds), the microcontroller MC sends a second control pulse to the triac TR, so that the latter ceases to be conductive; in this condition, the circuit is open and the supply to the heating element R3 is cut off.

Also in this case the triac can be opened when the voltage flowing through it is zero. As in the previous case, it should be noticed how the relay RL switches without any current on the contact CR, thus avoiding wear and sticking risks of the contact itself, as well as production of voltaic arches and electromagnetic or radio-frequency noise.

After 20 seconds (see position 6 of Table 1), the heating element R3 has to be supplied again; as it can be imagined, this is realized by making the triac TR conductive, and then causing the relay RL to switch; finally, the triac TR is taken back to its non conductive condition, exactly as previously described for the start of the drying cycle.

The first phase of modulation of the supply of the heating element R3 (20 sec ON and 20 sec OFF) described just above, occurs after a relatively short interval time following the start of the drying cycle (it should be reminded that the heating element R3 is oversized); this means that, following this first modulation phase of the heating element power, the mass of the laundry to be dried, being still wet, is considerable and therefore determines a certain drop of the air temperature. Therefore, into practice, after the first modulation phase, we can be in the conditions of items 7–10 (or 11 at the limit) of Table 1.

As it can be imagined, in these conditions, the control of the supply within the above reference periods of 40 sec will be performed by the microcontroller MC as per the procedures previously described, i.e. detecting the actual temperature by means of the sensor ST and controlling both the ON and OFF times of the heating element R3 through the triac TR and the relay RL, with the ON time lasting longer than the OFF time.

As the cycle progresses, the laundry will gradually dry up, so decreasing its own mass and requiring a lower heat supply for maintaining the drying temperature substantially at the steady-state value or around it, as defined by the ±4° C. range. Thus, we can be in the conditions according to positions 2–5 (or 1 at the limit) of Table 1.

Again, in these conditions, the control of the supply within the above reference periods of 40 sec will be performed by the microcontroller MC as per the procedures previously described, i.e. detecting the actual temperature by means of the sensor ST and controlling both the ON and OFF times of the heating element R3 by means of the triac TR and the relay RL, however, the OFF time will now last longer than the ON time.

The drying cycle will obviously progress up to the expiry of the 60 minutes as selected initially by the user, according to the procedures previously described.

From the above it is clear how the invention allows for a perfect achievement of the intended aims, and in particular:

the use of a single heating element being oversized allows for reaching the steady-state drying temperature or the temperature selected by the user in a relatively short time, in a simple and inexpensive manner;

the supply of proportional type of the heating element allows for maintaining a substantially constant drying temperature or anyway within limits being proximate to the value set by the user for the whole process, thus avoiding time and efficiency losses due to the hysteresis of the thermostats according to the prior art;

the solution of providing a solid state controlled switch (triac TR) connected in parallel to an electromechanical or electromagnetic switch (relay RL), where in particular the latter is always controlled when the former is conductive, makes the switching means of the electric supply circuit of the air heating resistance practically free from fault risks or wear, also when they are actuated with noticeable frequency, and warrants the compliance with the Standards on electromagnetic compatibility;

the components used for the implementation of the invention are extremely simple, reliable and cost-effective.

As to the last point, it should be noticed that the microcontroller required for implementing the invention may be the one of an electronic programmer of the machine, or the one being part of a sub-system of the machine itself (such as a speed control module of the motor producing the rotation of the drum containing the laundry to be dried).

Finally, an excellent method for coding in a compact way the information required for the operation of the drying machine according to the invention is offered by the control technology based on fuzzy logic, which is now widely used in the consumer's applications field, and in particular in the household appliances field. However, nothing hinders using other programming techniques, such as a method of the tabular type.

From the above description the features of the present invention are clear, and also its advantages are clear.

As described above, the method and the machine according to the invention provide for the use of an electric resistance R3 which, in the initial phase of the drying process, i.e. in the initial phase of the air heating, is supplied with continuously, in order to exploit its maximum power and quickly reach a predetermined temperature of the drying air (130° C., in the example of use described above).

Following the attainment of said predetermined temperature, a special control circuit, comprising a microcontroller MC, a relay RL, a triac TR and a temperature sensor ST, makes the resistance R3 to be supplied by wave trains, shuttering/modulating its supply and alternating supply phases to non-supply phases within repetitive reference periods; this in order to manage the power supplied by the heating element itself during the steady-state phase, for obtaining a substantial constancy of the air temperature.

It is obvious that many changes are possible for the man skilled in the art to the method for drying laundry and to the machine able to dry the laundry implementing such a method, described above by way of example, without departing from the novelty spirit of the innovative idea, and it is also clear that in practical actuation of the invention the components may often differ in form and size from the ones described and be replaced with technical equivalent elements.

According to a variant embodiment, the possibility is cited of providing a safety thermostat, of a known type, being connected in series to the resistance R3, in order to cut off the power supply to the latter in the event of a fault of the system; it should be noticed that the small cost increase due to the inclusion of this component is widely compensated by the other advantages of the invention, as previously described.

Another variant can consists in allowing, in a known way, the variation of the "duty cycle" of the supply voltage to the resistance, in particular always using the "zero cross detecting" method.

What is claimed:

1. A method for drying laundry, of the type which provides for the use of:

an electric resistance, for heating the drying air at a substantially predetermined temperature, sensor means of the temperature of the drying air, switching means, for controlling the electric power supply to said resistance, the method providing for the comparison between the actual temperature of the drying air, detected by means of said sensor means, with a value being representative of said predetermined temperature, during at least a portion of the drying process, the result of said comparison is used for generating control signals of said switching means, so as to perform a temperature control of the proportional type, i.e. providing for the modulation of the heating power of said resistance during subsequent reference periods, said control being performed by switching operations of said switching means for controlling, within one same reference period, the ratio of the supply time of said resistance with respect to non-supply time of said resistance, wherein said control is performed by switching a first switch connected in series on the supply line to said resistance, and a second switch arranged in parallel to said switch on the supply line to said resistance.

2. A method, according to claim 1, wherein the supply to said resistance is enabled as follows:

the closure of said second switch effected while said first switch is in open condition;

after a time deemed to be sufficient for realizing the closure of said second switch has elapsed, the closure of said first switch is effected;

after a time deemed to be sufficient for realizing the closure of said first switch has elapsed, said second switch is made to open.

3. A method, according to claim 1 wherein said first switch is made to close or open always with said second switch being in its closed condition.

4. A method, according to claim 1, wherein the supply of said resistance is deactivated as follows:

the closure of said second switch is effected when said first switch is in its closed condition;

after a time deemed to be sufficient for realizing the closure of said switch has elapsed, the opening of said first switch is effected;

after a time deemed to be sufficient for realizing the closure of said first switch has elapsed, said second switch is made to opened.

5. A method, according to claim 1, wherein the switching operation of said second switch are performed in correspondence of the zero-crossing.

6. A method, according to claim 1, wherein the control of said ratio is performed within a temperature range, laying in the surroundings of the vale of predetermined temperature, said range having in particular amplitude of at least ±4° C. respect to the value of said predetermined temperature.

7. A method, according to claim 6, wherein, when the temperature detected by said sensor means falls within said range, the supply and the non-supply times of said resistance within a reference period are changed as a function of the difference existing between the detected temperature and the value of slid predetermined temperature.

8. A method, according to claim wherein said reference periods last about 40 seconds.

9. A method, according to claim 1, wherein said portion of to dry process is realized following the attainment of a predetermined temperature threshold of the drying air, detected by said sensor means.

10. A method, according to claim 9, wherein before reaching said temperature threshold resistance is applied continuously.

11. A method, according to claim 7, wherein, when the temperature detected by said sensor means exceeds the lower or upper limit of said range, the supply to said resistance is activated or deactivated, respectively, for the whole duration of reference period.

12. A method, according to claim 7, wherein, when the temperature detected by said sensor means during a first referees period is below the value of said predetermined temperature, the supply time said resistance during the subsequent reference period increased compared to supply time period in said first reference period.

13. A method, according to claim 7, wherein, when the temperature detected by said sensor during a first reference period exceeds the value of predetermined temperature, supply time of said resistance during the subsequent reference period is reduced compared to supply time provided in said first reference period.

14. A machine able to dry laundry, comprising:

an electric resistance for heating the drying air at a substantial predetermined temperature, a sensor means of the temperature of said air, control means of the supply of said resistance, comprising at least a first switch connected in section on the supply line of said resistance, and at least a second switch said first and second switch are controlled by said control means, particular by means of microcontroller, said second switch being connected in parallel to said first switch on the supply line of said resistance, wherein said control means or microcontroller are programed for switching said first switch only when said second switch is closed condition.

15. A machine, according to claim 14, wherein said first switch is an electromehanical or electromagnetic switch.

16. A machine, according to claim 14, wherein said first switch comprises a relay, having a coil and a normally open movable contact.

17. A machine, according to claim 14, wherein said second switch is a solid state controllable electronic switch.

18. A machine, according to claim 17, wherein said second switch comprises a triac.

19. A machine, according to claim 14, wherein said sensor means comprises a resistor a negative temperature coefficent, or NTC.

20. A machine, according to claim 14, wherein said control means comprise a microcontroller, which is programmed comparing the actual temperature of the drying air, detected through said sensor means, a value being representative of said predetermined temperature, and supplying control signals for said first switch and said second switch.

21. A machine, according to claim 14, wherein said microcontroller is programmed for realizing a temperature control of the proportional type or featured by the modulation of the heating power of said resistance.

22. A machine, according to claim 21, wherein said microcontroller is programmed for controlling the switching operations of the supply of supply resistance, by means of said first switch and said second switch, during repetitive reference periods, said switching operations being directed to control, within one same reference period, the ratio of the supply time of said resistance with respect to the non-supply time of said resistance.

23. A machine, according to claim 22, wherein the control of ratio is performed within a temperature range, laying in the surroundings of the value of said predetermined temperature, said range having in particular an amplitude of at least ±4° C. with respect to the value of said predetermined temperature.

24. A machine, according claim 23, wherein said microcontroller is programed for changing, within a reference period, the supply and non-supply times of said resistance as a function of the difference between the detected temperature and the value of said predetermined temperature, when the temperature detected by said sensor means falls within said range.

25. A machine, according to claim 14, wherein, in order to enable the supply of said resistance, said microcontroller is programed for sending a first control signal to said second switch or triac, to make the latter conductive and so closing the circuit from the electric supply source to said resistance, when said first switch or relay is in open condition.

26. A machine, according to claim 25, wherein said microcontroller is programmed for making said first switch or relay to close, once a first determined time starting from the sending of said first signal has elapsed.

27. A machine, according to claim 26, wherein said microcontroller is programmed for sending a second control signal to said second switch triac, so that the latter ceases to be conductive after a second determined time, deemed to be sufficient for realizing the closure of said first switch or relay, has elapsed.

28. A machine, according to claim 14, wherein, in order to deactivate the supply to said resistance, said microcontroller is programmed for sending a first control signal to said second switch or triac, for making the latter to become conductive and so closing the circuit between the electric supply source and said resistance, with said first switch or relay being in closed condition.

29. A machine, according to claim 28, wherein said microcontroller is programmed to control the opening said first switch or relay, after a first determined time, starting from sending of said first signal, has elapsed.

30. A machine, according to claim 29, wherein said microcontroller is programed for sending a second control signal to said second switch or triac, so that the latter ceases to be conductive, after a second determined time, deemed to be sufficient for realizing the opening of said first switch or relay, has elapsed.

31. A machine, according to claim 14, wherein it provides only one air heating resistance, which has in particular an oversized power with respect to the power required for maintaining said predetermined temperature.

32. A machine, according to claim 14, comprising selection means for setting said predetermined temperature.

33. A machine, according to claim 14, comprising selection means for setting the drying time.

34. A machine, according to claim 14, comprising a safety thermostat connected in series with said resistance.

* * * * *